US007770950B1

(12) United States Patent
Liu

(10) Patent No.: US 7,770,950 B1
(45) Date of Patent: Aug. 10, 2010

(54) CHOPSTICKS

(76) Inventor: Ming-Huang Liu, No. 24, Lane 1, Dahan St., Shengang Township, Taichung County (TW)

( * ) Notice: Subject to any disclaimer, the term of this patent is extended or adjusted under 35 U.S.C. 154(b) by 0 days.

(21) Appl. No.: 12/463,406

(22) Filed: May 10, 2009

(51) Int. Cl.
*A47G 21/10* (2006.01)
*B25B 9/02* (2006.01)

(52) U.S. Cl. ..... 294/1.1

(58) Field of Classification Search ..... 294/1.1, 294/99.2; 403/109.4, 109.5
See application file for complete search history.

(56) References Cited

U.S. PATENT DOCUMENTS

| | | | | |
|---|---|---|---|---|
| D283,192 | S | 4/1986 | Kono | |
| 4,887,625 | A * | 12/1989 | Archer | 403/109.4 |
| D433,883 | S | 11/2000 | Wei | |
| D546,133 | S | 7/2007 | Georeovich | |
| 2009/0091146 | A1* | 4/2009 | Liu | 294/1.1 |
| 2009/0121501 | A1* | 5/2009 | Liu | 294/1.1 |

FOREIGN PATENT DOCUMENTS

| | | | |
|---|---|---|---|
| DE | 3541647 | | 5/1987 |
| JP | 09252911 | * | 9/1997 |
| JP | 2000333811 | * | 12/2000 |
| JP | 2001299552 | * | 10/2001 |
| JP | 2006-20700 | | 5/2007 |

* cited by examiner

*Primary Examiner*—Paul T Chin
(74) *Attorney, Agent, or Firm*—Egbert Law Offices PLLC

(57) ABSTRACT

The present invention provides an assembled set of chopsticks, having a handle, a cover, a link locator and a gripping portion. The link locator has a stepped tube and a screwed positioning seat. A frictional flange is arranged externally at the central section of the stepped tube's embedding section of the link locator and is frictionally mated with the handle's bottom port. A frictional ring surface is protruded at the central section of the external wall of the screwed positioning seat external wall and also frictionally mated with the stepped tube's through-hole, enabling the link locator to be assembled more stably and smoothly. The gripping bottom is provided with both an axial groove and skid ring groove, the gripping area and frictional effect being increased for a better gripping stability without slippage.

5 Claims, 11 Drawing Sheets

CHOPSTICKS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a kind of chopsticks, and more particularly to innovative chopsticks that require assembly.

2. Description of Related Art Including Information Disclosed Under 37 CFR 1.97 and 37 CFR 1.98.

Users may find it inconvenient to carry chopsticks due to their slender shape, so some chopsticks requiring assembly have been developed for resolving this problem.

However, the following shortcomings of typical assembled sets of chopsticks are observed.

Despite the fact that the length of the chopstick parts is reduced when disassembled, the number of components has increased, leading possibly to loss during cleaning or storage, or failure of reassembly.

When the chopsticks are assembled, both ends of the coupling components are separately screwed onto the handle and clamping portion. So, there will be several coupling states when the clamping portion is loosened again, and the coupling components may be loosened simultaneously with the clamping portion, or still linked with the handle, or fall off after disengagement from the handle and clamping portion, thus increasing the instability in use of chopsticks.

The chopsticks can assist the users in easily handling noodles or meals, such as spiced eggs, pork balls and sausage, but these chopsticks are generally formed with tapered ends (columns or angle columns) to avoid any personal injury. When the users intend to grip foods with chopsticks, the foods cannot be gripped firmly due to the smooth and narrow clamping surface of the two chopsticks. Moreover, when the users intend to insert the chopsticks into spiced eggs and pork balls, etc, slipping, rolling and tripping off may occur when inserting force is applied, leading to inconvenience of operation.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based on the structure of the present invention, a frictional flange is arranged externally at the central section of the stepped tube's embedding section of the link locator for frictional mating with the handle's bottom port. A frictional ring surface is protruded on the external wall of the screwed positioning seat and also frictionally mated with the through-hole of the stepped tube. Thus, the link locator can be assembled more stably and robustly without the need of punched holes on the external wall of the handle, thereby improving aesthetics and quality of the assembled set of chopsticks.

Based on the structure of the present invention, the gripping bottom is provided with both an axial groove and skid ring groove. The gripping area and frictional effect could be increased for a better gripping stability. Moreover, the cross section of the gripping bottom could be reduced, such that the assembled set of chopsticks could be inserted into foods more easily and conveniently.

Based on the structure of the present invention, a frictional flange is arranged externally at the central section of the stepped tube's embedding section. The embedding section could be partially inserted into the bottom port of the handle, so that the frictional flange is forcibly pushed into the bottom port without slippage, and the assembly process can be implemented more smoothly with minimum error.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
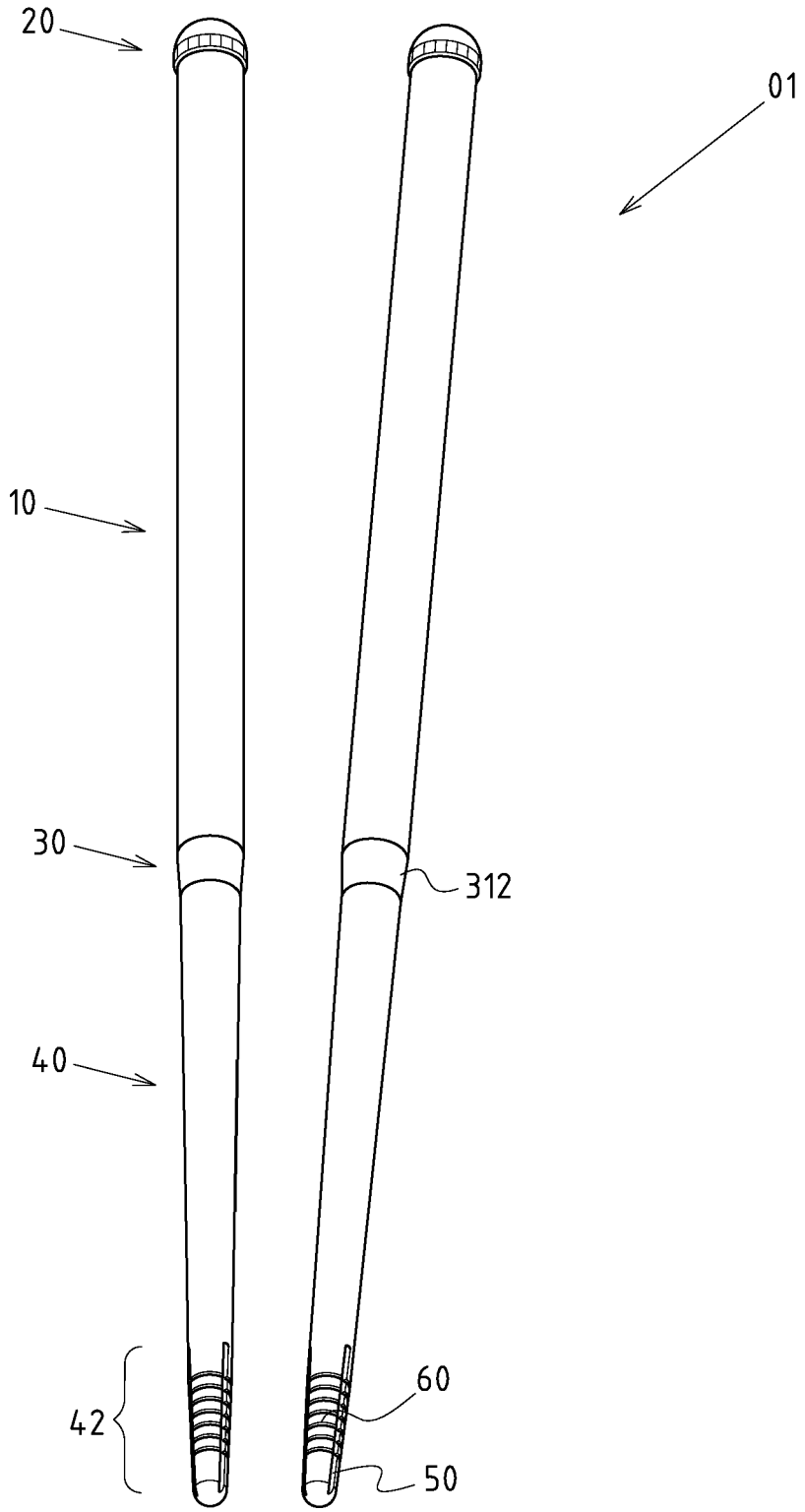
FIG. 1 shows an assembled perspective view of the assembled set of chopsticks of the present invention.

FIGS. 1-4 depict preferred embodiments of an assembled set of chopsticks of the present invention. The embodiments are provided for only explanatory purposes with respect to the claims.

The assembled set of chopsticks 01 comprises a handle 10, a cover 20, a link locator 30 and a gripping portion 40.

The handle 10 is a hollow straight tube, wherein an accommodation space 11, a top port 12 and a bottom port 13 are formed.

Figure 10:
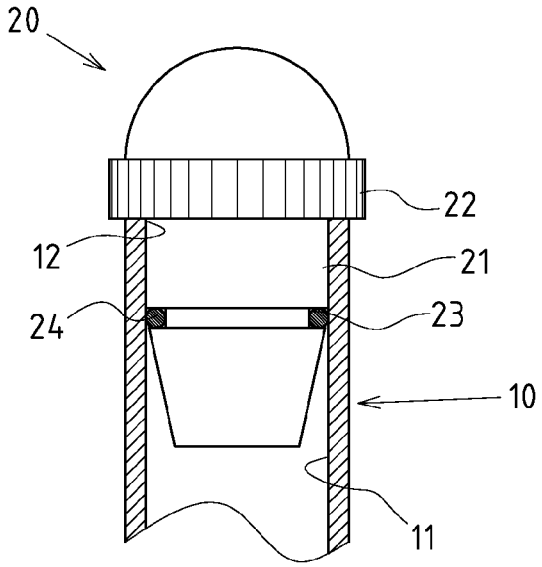
FIG. 10 shows a sectional view of the cover assembly position of the present invention.

The cover 20 is covered onto the top port 12 of the handle 10. The cover 20 comprises a protruding column 21 and an expanded tip 22 set at the top of the protruding column 21. Moreover, the protruding column 21 is provided with a circular groove 23, which is fitted with a snap ring 24. The snap ring 24 is made of a C-shaped metal ring as shown in FIG. 10. When the protruding column 21 of the cover 20 is assembled into the top port 12 of the handle 10, it can be retained onto the inner wall of the top port 12 via the flexible support of the snap ring 24, enabling the secure positioning of the cover 20.

The link locator 30 consists of a stepped tube 31, which is comprised of an embedding section 311 and an expanded section 312 set at the bottom of the embedding section 311. The embedding section 311 can be inserted into the bottom port 13 of the handle 10. A frictional flange 313 is arranged externally at the central section of the embedding section 311. The external diameter of the frictional flange 313 is slightly bigger than the aperture of the bottom port 13 of the handle 10, allowing for frictional mating between the frictional flange 313 and bottom port 13. The stepped tube 31 is provided internally with a through-hole 314.

The link locator 30 also consists of a screwed positioning seat 32, which is comprised of an external wall 322 and a tapped through-hole 323 at the center. The external wall 322 is inserted into the top of through-hole 314 of the stepped tube 31, and a frictional ring surface 324 is protruded at the central section of the external wall 322. The external diameter of the frictional ring surface 324 is slightly bigger than the aperture of the through-hole 314 of the stepped tube 31, allowing for frictional mating between the frictional ring surface 324 and through-hole 314.

A gripping portion 40 is comprised of a coupling top 41 and a gripping bottom 42. A stud 411 is protruded from the coupling top 41 and screwed into the tapped through-hole 323 of the screwed positioning seat 32. At least an axial groove 50 is configured along the extended direction of the gripping bottom 42 of the gripping portion 40. A plurality of skid ring grooves 60 are arranged at intervals onto the gripping bottom 42 of the gripping portion 40.

The structural hardness of the screwed positioning seat 32 of the link locator 30 is bigger than that of the stepped tube 31. For instance, the screwed positioning seat 32 may be made of copper, and the stepped tube 31 made of aluminum. So, when the screwed positioning seat 32 is stuffed into the through-hole 314 of the stepped tube 31, a satisfactory pressing state could be realized through their mating, and the screwed positioning seat 32 of relatively bigger structural hardness could ensure that the tapped through-hole 323 will not be deformed from the tight mating of the screwed positioning seat 32 and stepped tube 31.

Figure 2:
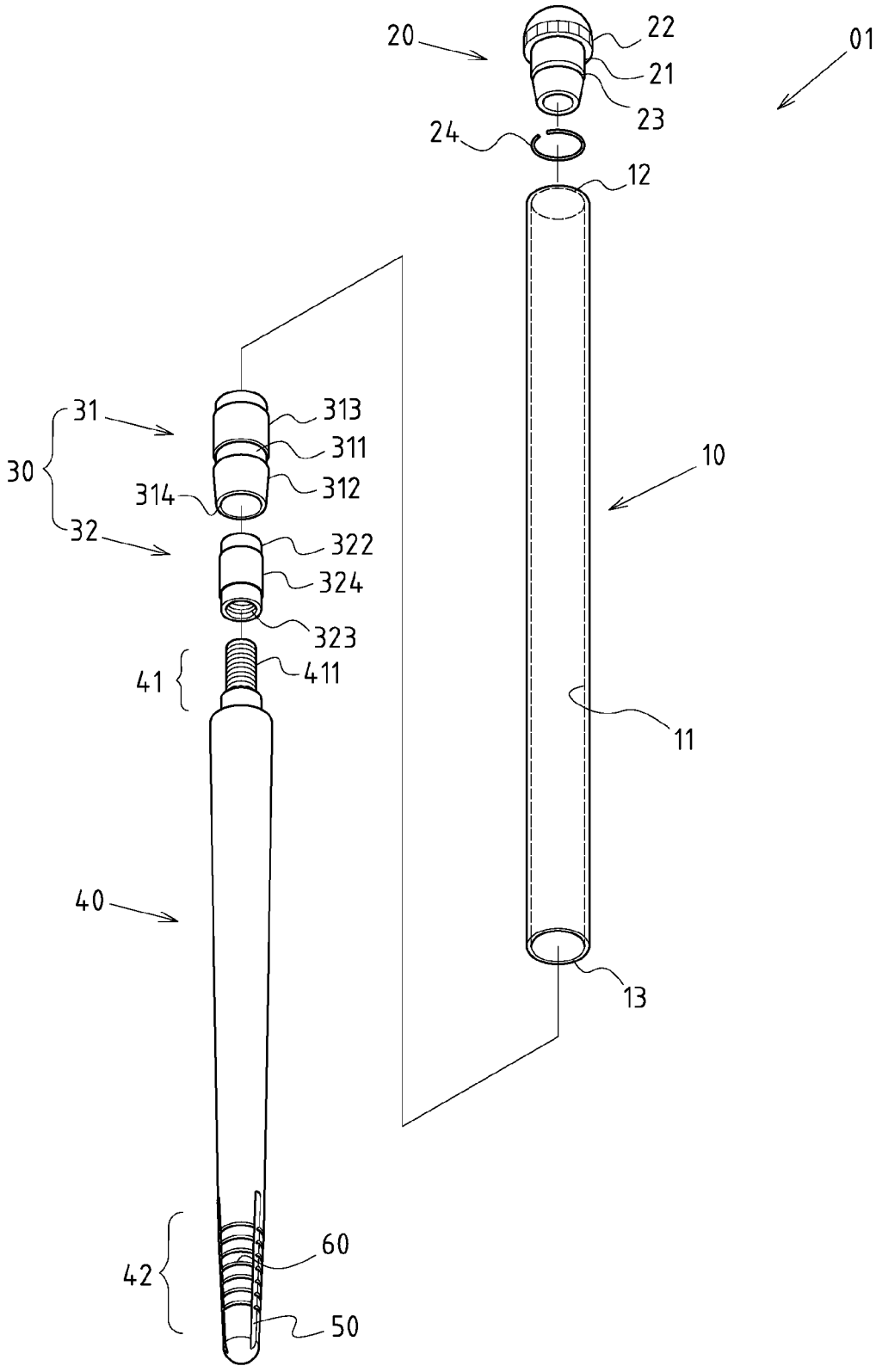
FIG. 2 shows an exploded perspective view of the assembled set of chopsticks of the present invention.
Figure 3:
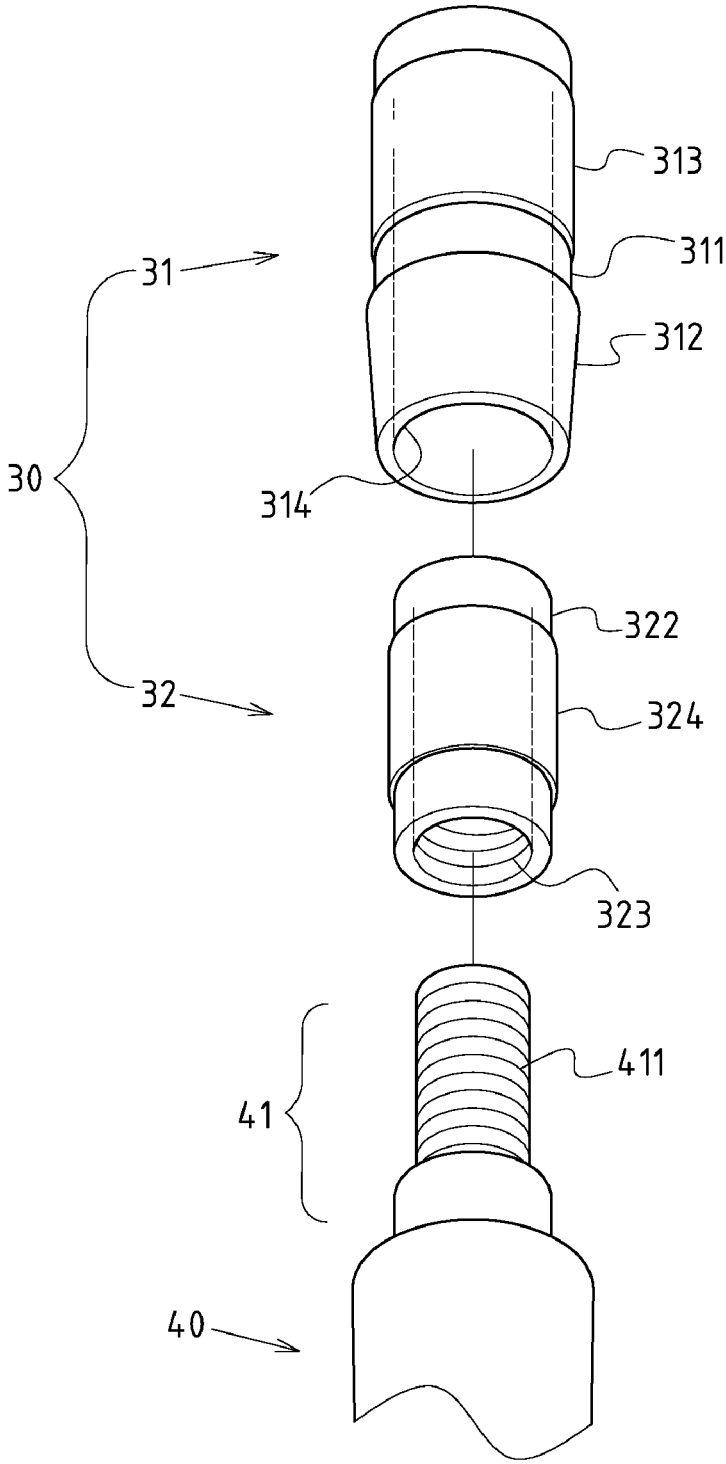
FIG. 3 shows a partially enlarged perspective view of the components in FIG. 2.
Figure 4:
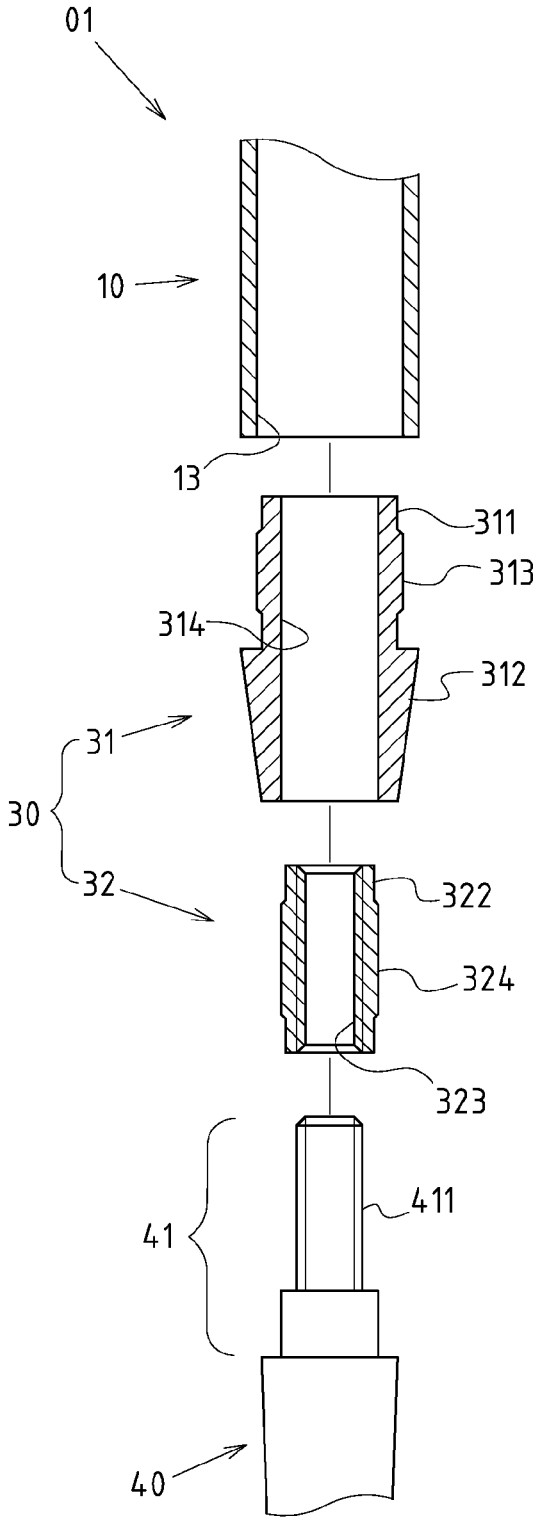
FIG. 4 shows an exploded sectional view of the components of the present invention.

Based upon above-specified structure, the present invention is operated as follows:

FIGS. 2-4 depict the exploded state of the handle 10, link locator 30 and gripping portion 40 of the assembled set of chopsticks 01.

Figure 5:
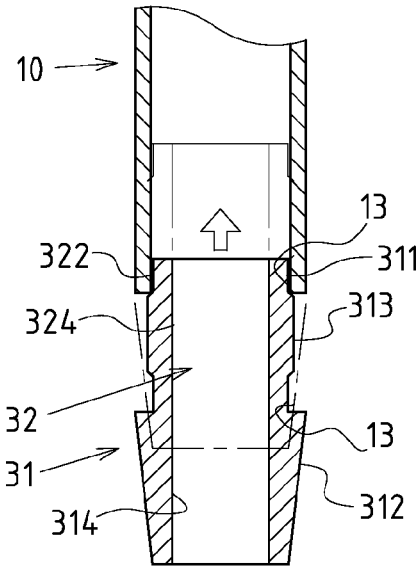
FIG. 5 shows a sectional view of assembly step 1 for the components of the present invention.

The assembly sequence of the assembled set of chopsticks 01 is shown in FIG. 5, wherein the stepped tube 31 is firstly assembled into the bottom port 13 of the handle 10. In such a case, the frictional flange 313 and the bottom port 13 are mated frictionally, so that the stepped tube 31 and the bottom port 13 of the handle 10 are firmly mated and positioned owing to the fact that the external diameter of the frictional flange 313 for the stepped tube 31 is slightly bigger than the aperture of the bottom port 13. The other characteristic is that the embedding section 311 of the stepped tube 31 can be partially inserted into the bottom port 13 (i.e. the state disclosed in FIG. 5). In such a case, the frictional flange 313 is still retained externally onto the bottom port 13, ensuring that the frictional flange 313 is forcibly pushed into the bottom port 13 without slippage, and the assembly process can be implemented more smoothly with minimum error.

Figure 6:
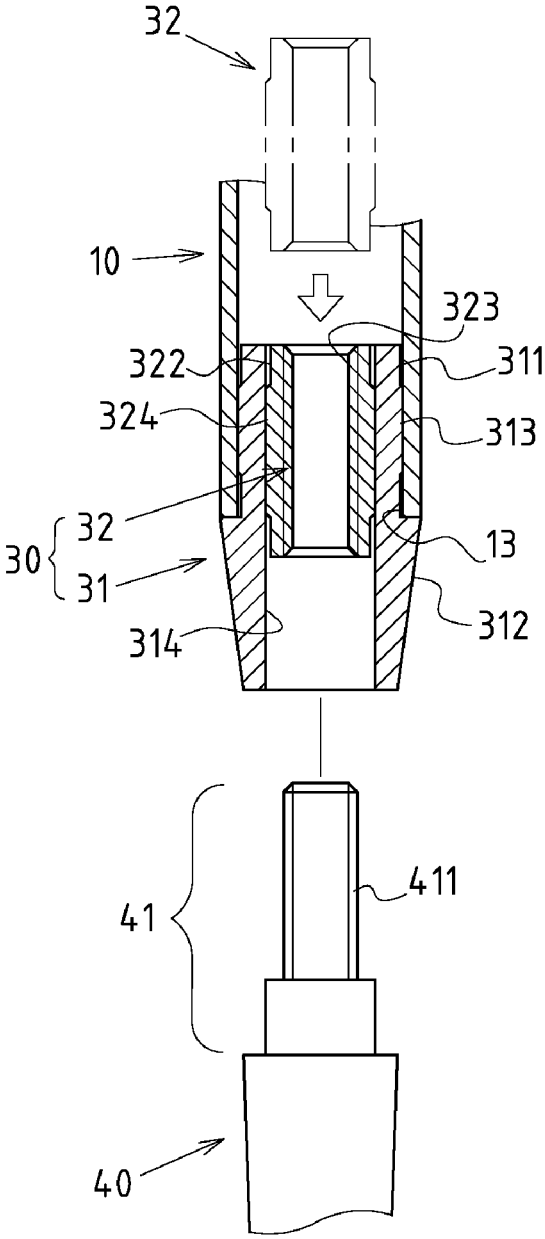
FIG. 6 shows a sectional view of assembly step 2 for the components of the present invention.

Referring also to FIG. 6, the screwed positioning seat 32 is stuffed into the through-hole 314 of the stepped tube 31 from the accommodation space 11 of the handle 10. Since the frictional ring surface 324 of the screwed positioning seat 32 is frictionally mated with the through-hole 314, the screwed positioning seat 32 and the through-hole 314 can be tightly mated for a better positioning effect.

Figure 7:
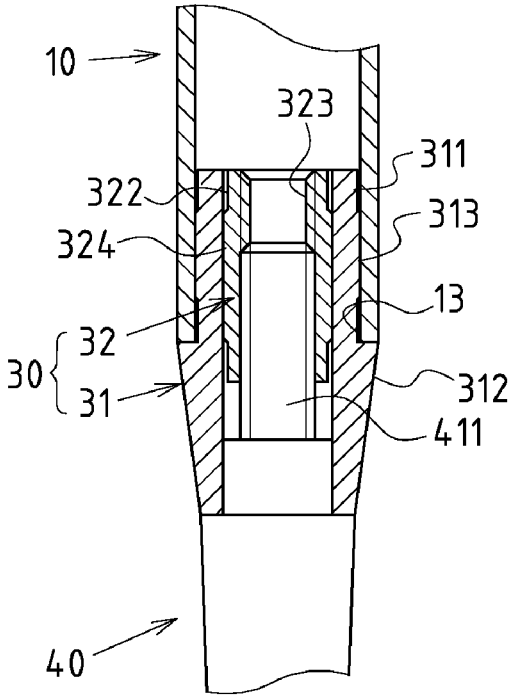
FIG. 7 shows a sectional view of assembly step 3 for the components of the present invention.

Referring also to FIG. 7, when the gripping portion 40 is coupled with the stepped tube 31, the gripping portion 40 is screwed into the tapped through-hole 323 of the screwed positioning seat 32 of stepped tube 31 via the stud 411 at the coupling top 41.

Figure 8:
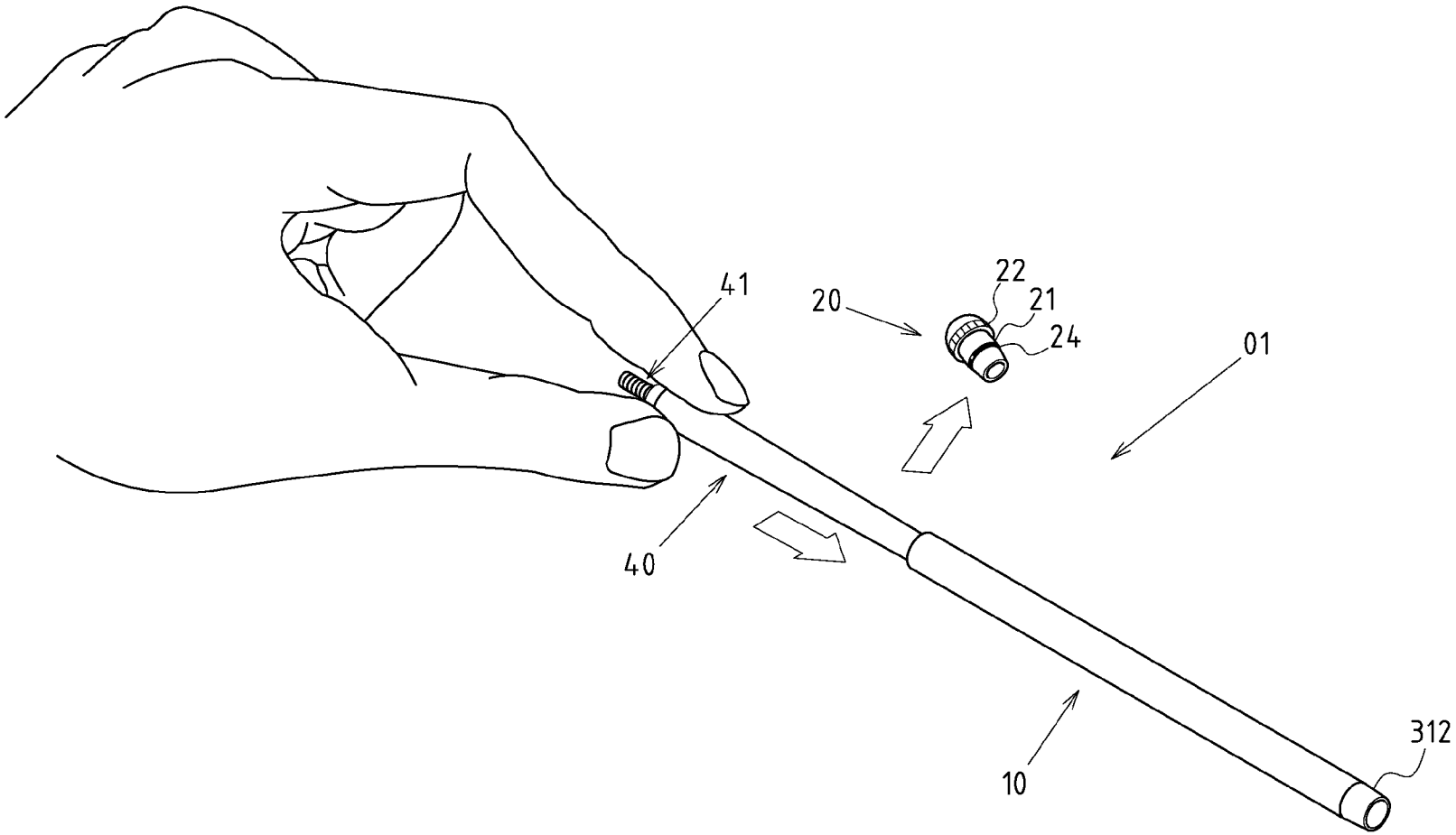
FIG. 8 shows a perspective view of the use of the present invention.

Referring also to FIG. 8, when the gripping portion 40 is to be removed from the handle 10, the cover 20 for the top port 12 of the handle 10 could be firstly disassembled, then the removed gripping portion 40 is retracted into the accommodation space 11 of the handle 10, so the assembled set of chopsticks 01 could be halved in length and volume, making it convenient to carry the chopsticks.

Figure 9:
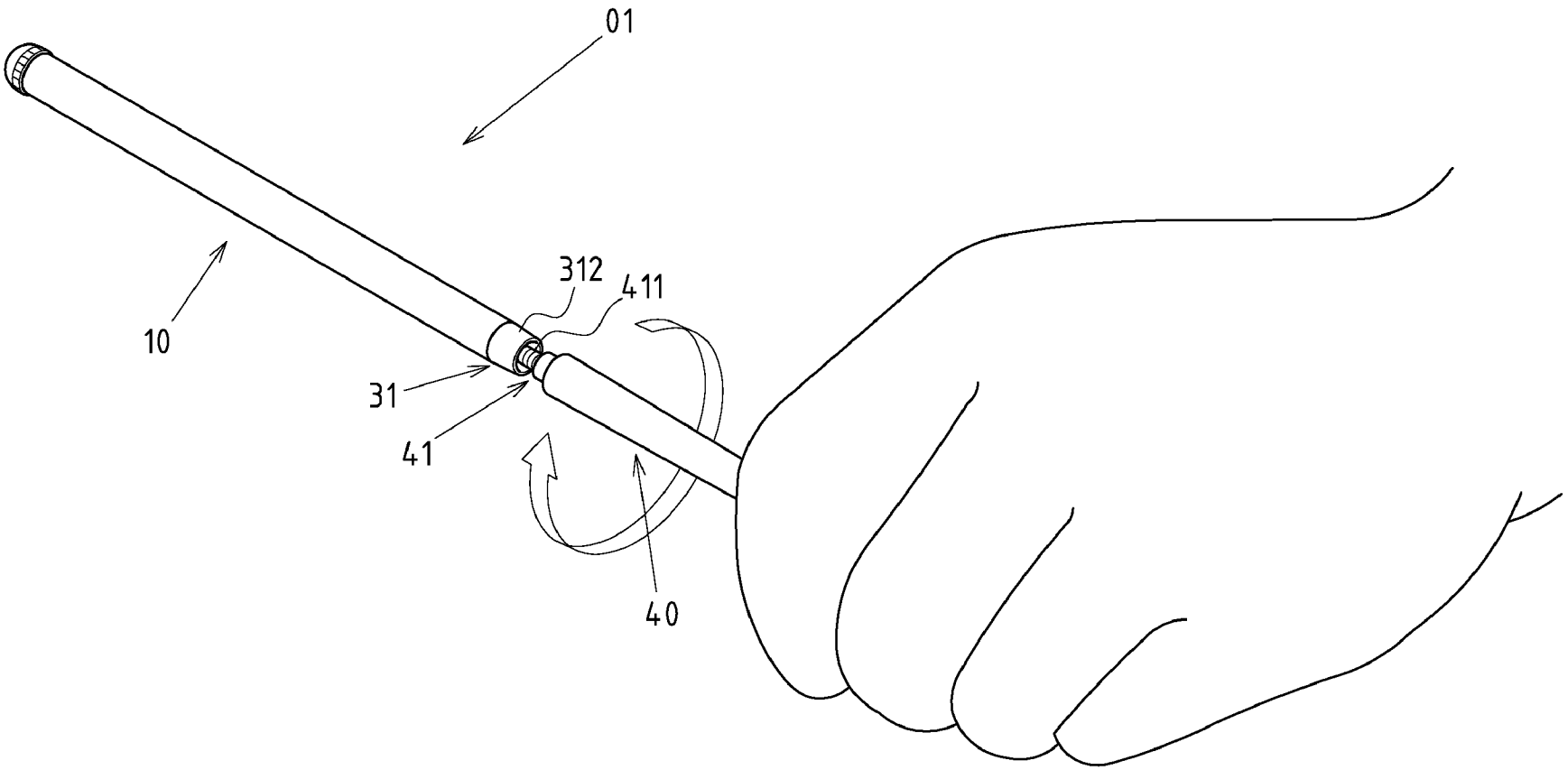
FIG. 9 shows a second perspective view of the user of the present invention.

Referring also to FIG. 9, when the users intend to use the assembled set of chopsticks 01, they are only required to take out the gripping portion 40 from the accommodation space 11 of the handle 10 and then assemble into the tapped through-hole 323 on the screwed positioning seat 32 of the stepped tube 31 (also shown in FIG. 7), thus making it readily accessible for the users.

Figure 12:
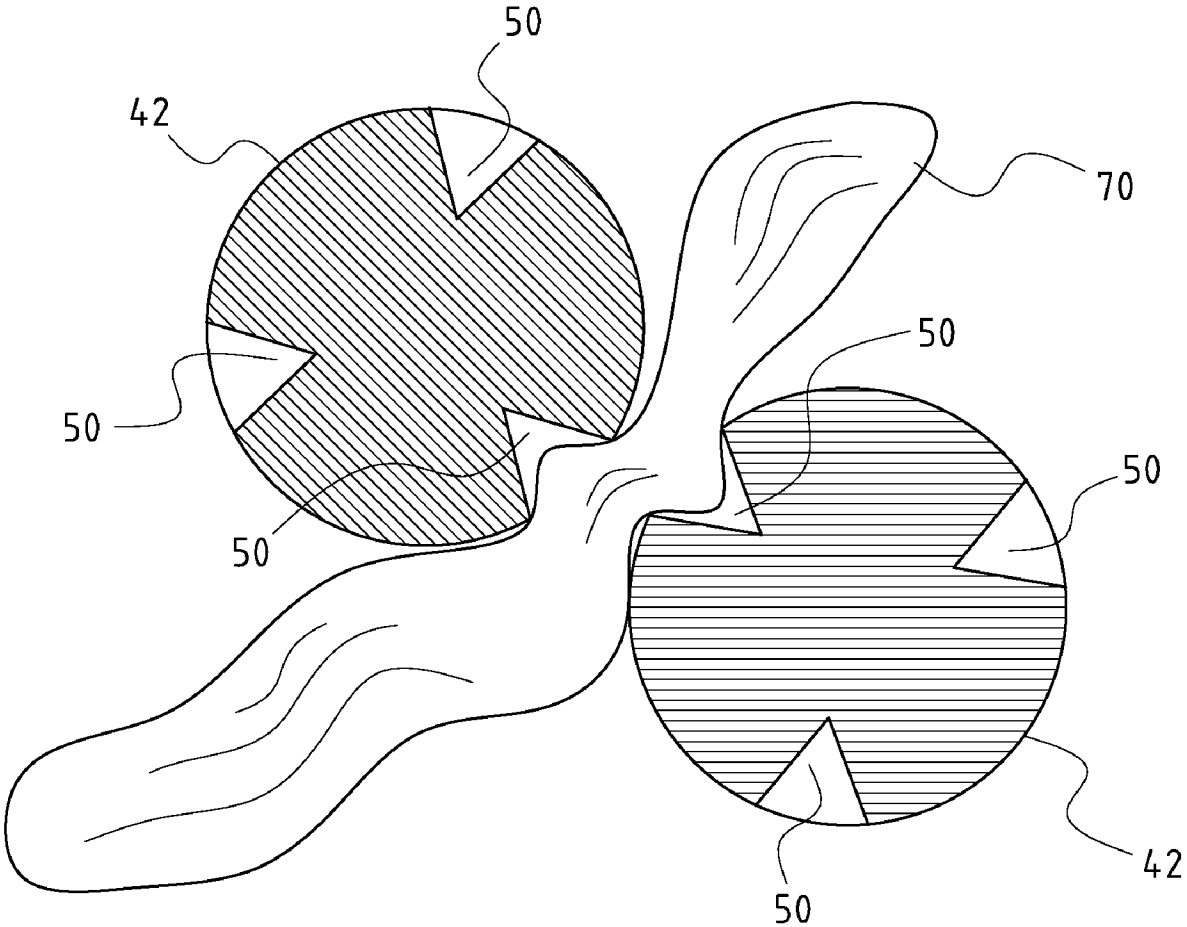
FIG. 12 shows a schematic view of the actuation of the axial groove when the assembled set of chopsticks is used for gripping foods.

On the other hand, based on the structure, wherein an axial groove 50 is configured along the extended direction of the gripping bottom 42 of the gripping portion 40, as shown in FIG. 12, when the assembled set of chopsticks 01 is used for gripping vegetable or meat, the food 70 will be partially squeezed into the axial groove 50 and get contact with the skid ring groove 60 due to the gripping state between two gripping bottoms 42. Then, in conjunction with the friction generated by a plurality of skid ring grooves 60 set for the gripping bottom 42, the assembled set of chopsticks 01 allows for better contact and frictional effect.

Figure 13:
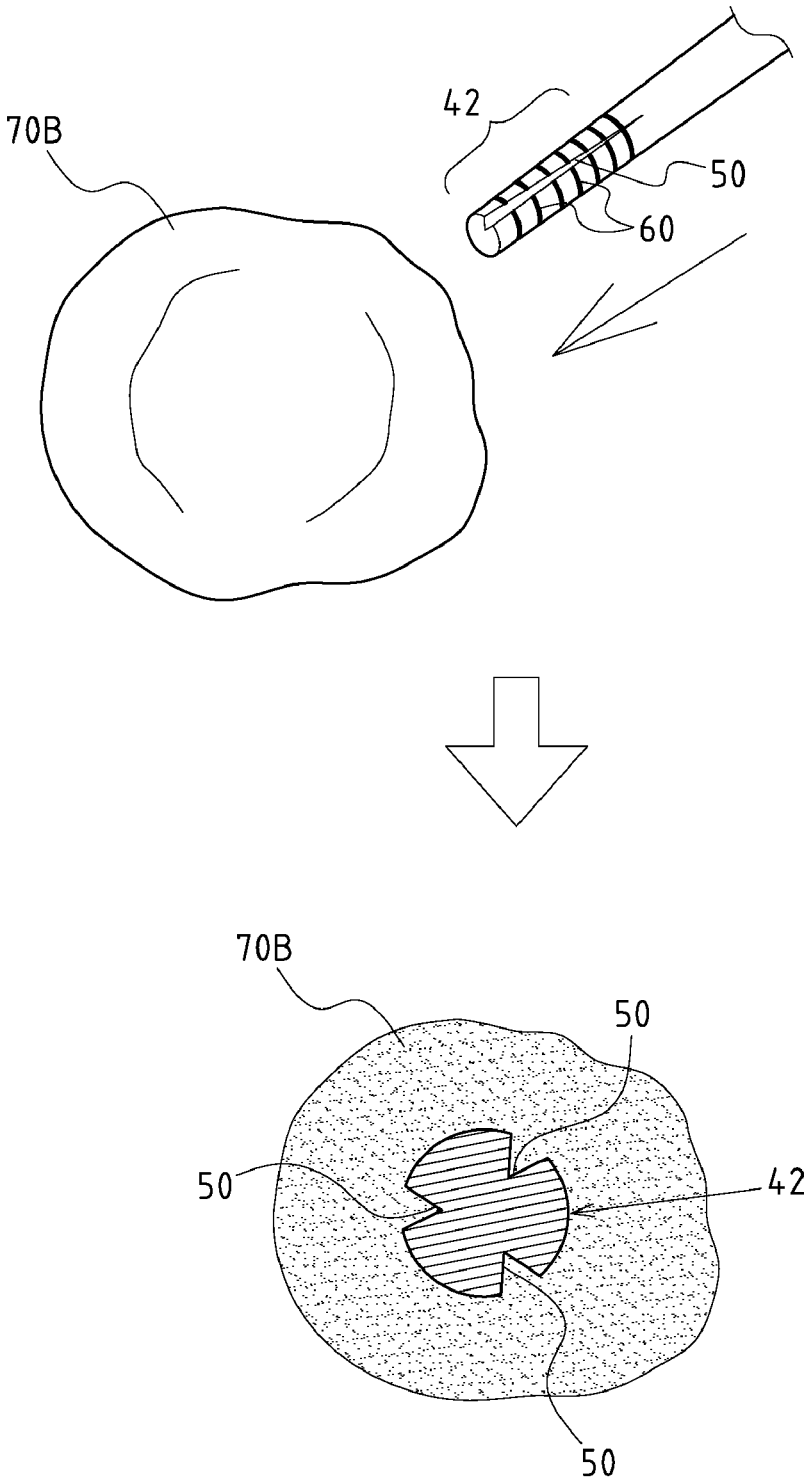
FIG. 13 shows a second schematic view of the actuation of the axial groove when the assembled set of chopsticks is used for inserting into foods.

Referring also to FIG. 13, when the assembled set of chopsticks 01 is used for inserting into such foods 70B as spiced eggs, pork balls and sausage, the cross section of the gripping bottom 42 could be reduced by the axial groove 50 designed for the gripping bottom 42, such that it could be partially inserted into the axial groove 50, preventing the foods 79B from falling off in conjunction with the friction generated by a plurality of skid ring grooves 60.

Figure 11:
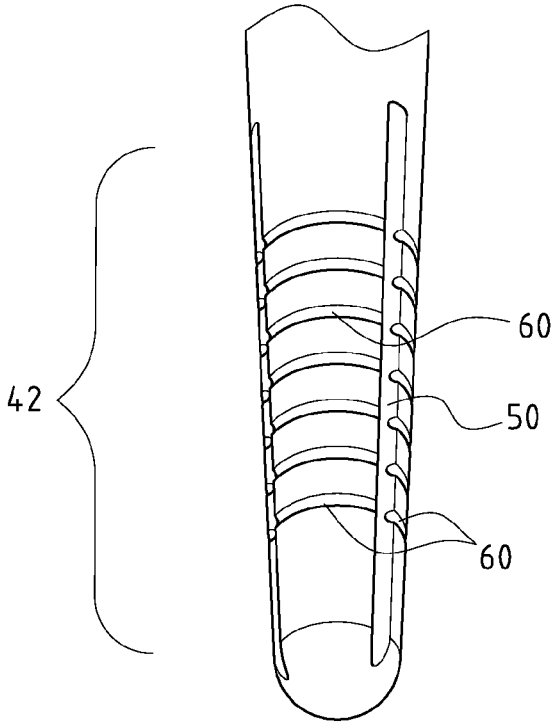
FIG. 11 shows an enlarged perspective view of the gripping bottom of the present invention.
Figure 14:
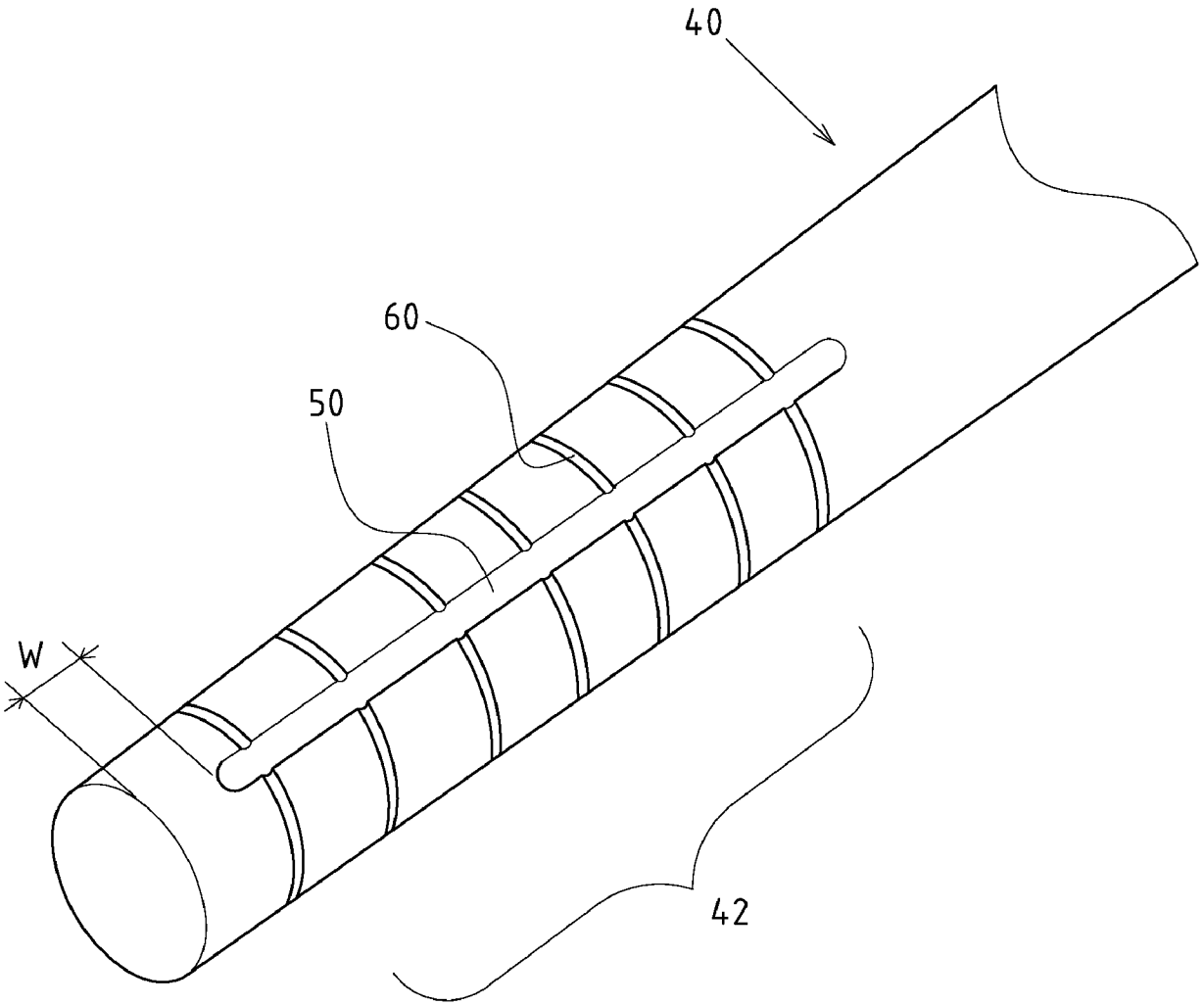
FIG. 14 shows a perspective view of the application of the present invention that the bottom of the axial groove has a spacing with the end of the gripping bottom.

Furthermore, the bottom of the axial groove 50 may slide through the end of the gripping bottom 42 (shown in FIG. 11). Alternatively, the bottom of the axial groove 50 has a spacing (W) with the end of the gripping bottom 42 (shown in FIG. 14). The axial grooves 50 may account to 1-3.

I claim:

1. An assembled set of chopsticks, comprising:

a handle being a hollow straight tube and having an accommodation space, a top port and a bottom port formed therein;

a cover onto said top port of said handle, said cover being comprised of a protruding column and an expanded tip set at a top of the protruding column, said protruding column being provided with a circular groove fitted with a snap ring;

a link locator comprising:

a stepped tube, being comprised of an embedding section, an expanded section set at a bottom of said embedding section, said embedding section being inserted into the bottom port of the handle, and a frictional flange arranged externally at a central section of the embedding section, said frictional flange having an external diameter bigger than an aperture of the bottom port of the handle, said frictional flange and bottom port being frictionally mated, said stepped tube being provided internally with a through-hole; and a screwed positioning seat, being comprised of an external wall and a tapped through-hole at the center, said external wall being inserted into a top of through-hole of the stepped tube, said external wall having a central section with a frictional ring surface protruded at the central section, said frictional ring surface having an external diameter bigger than an aperture of the through-hole of the stepped tube, said frictional ring surface and the through-hole being frictionally mated, the screwed positioning seat having greater hardness than the stepped tube; and a gripping portion, being comprised of a coupling top and a gripping bottom, said coupling top having a stud is protruded therefrom and screwed into the tapped through-hole of the screwed positioning seat, said gripping portion having at least an axial groove, configured along an extended direction of the gripping bottom of the gripping portion, and said gripping portion having a plurality of skid ring grooves, arranged at intervals onto the gripping bottom of the gripping portion.

2. The assembled set of chopsticks defined in claim 1, wherein the snap ring for the circular groove of the protruding column is comprised of a C-shaped metal ring.

3. The assembled set of chopsticks defined in claim 1, wherein the bottom of the axial groove slides through the end of the gripping bottom.

4. The assembled set of chopsticks defined in claim 1, wherein the bottom of the axial groove has a spacing with the end of the gripping bottom.

5. The assembled set of chopsticks defined in claim 1, wherein the axial groove is V-shaped, circular or curved profile.

* * * * *